US007628589B2

(12) United States Patent
Becker

(10) Patent No.: US 7,628,589 B2
(45) Date of Patent: Dec. 8, 2009

(54) TURBO-ENGINE AND ROTOR FOR A TURBO-ENGINE

(75) Inventor: Bernard Becker, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 376 days.

(21) Appl. No.: 11/547,943

(22) PCT Filed: Mar. 14, 2005

(86) PCT No.: PCT/EP2005/002710

§ 371 (c)(1),
(2), (4) Date: Oct. 6, 2006

(87) PCT Pub. No.: WO2005/100751

PCT Pub. Date: Oct. 27, 2005

(65) Prior Publication Data

US 2008/0267781 A1 Oct. 30, 2008

(30) Foreign Application Priority Data

Apr. 7, 2004 (EP) ..... 04008485

(51) Int. Cl.
*F01D 5/32* (2006.01)

(52) U.S. Cl. ..... 416/221; 416/244 A; 416/248

(58) Field of Classification Search ..... 416/221, 416/219 R, 220 R

See application file for complete search history.

(56) References Cited

U.S. PATENT DOCUMENTS 3,157,385 A * 11/1964 Jenson ..... 416/221
4,439,107 A * 3/1984 Antonellis ..... 416/220 R
4,507,052 A * 3/1985 Thompson ..... 416/220 R
5,211,407 A 5/1993 Glynn et al.
6,190,131 B1 * 2/2001 Deallenbach ..... 416/221

FOREIGN PATENT DOCUMENTS

CH 489 698 4/1970
CH 0489698 * 4/1970
DE 26 06 565 A1 9/1976

* cited by examiner

*Primary Examiner*—Richard Edgar

(57) ABSTRACT

The invention relates to a rotor for a non-positive-displacement machine, particularly a rotor for a compressor of a gas turbine, on which at least one shaft collar with an outer periphery and with two radially extending faces are placed. The rotor also comprises a multitude of retaining grooves for moving blades, said retaining grooves being provided on the outer periphery and extending transversal to the peripheral direction and each retaining groove has a groove bottom. In order to provide a rotor for a non-positive-displacement machine that makes it possible to reduce flow losses while having a simple geometrical design of the attachment of moving blades, the invention provides that an annual groove, which extends in an axial direction and which is coaxial to the rotation axis of the rotor, is provided at least on one face of the shaft collar. This annular groove is joined to the groove bottom of the retaining grooves whereby enabling material of the foot of the moving blade to be plastically forced into the annular groove.

14 Claims, 4 Drawing Sheets

TURBO-ENGINE AND ROTOR FOR A TURBO-ENGINE

CROSS REFERENCE TO RELATED APPLICATIONS

This application is the US National Stage of International Application No. PCT/EP2005/002710, filed Mar. 14, 2005 and claims the benefits of European Patent application No. 04008485.7 filed Apr. 7, 2004. All of the applications are incorporated by reference herein in their entirety.

FIELD OF THE INVENTION

The invention refers to a rotor for a turbo-engine and a turbo-engine with a rotor as claimed in the claims.

BACKGROUND OF THE INVENTION

From U.S. Pat. No. 5,211,407 a fastening of rotor blades of a compressor on the disk of the compressor rotor is known, in which the locking of the rotor blades against axial displacement is effected by an annular retaining segment. For this, the disk has radially inwards extending hooks on the end face between two rotor blade retaining slots into which is hooked a retaining segment. The retaining segment forms a stop for the rotor blade held in the retaining slot and so locks this against axial displacement.

In addition to this, a method for the fitting of rotor blades in a disk is described in DE 26 06 565. In this, the end face regions of a platform of a rotor blade are deformed in such a way that after a caulking action the material regions of the platform which are facing the outer periphery of the disk bear tightly against the disk in order to achieve a frictional damping.

Furthermore, CH 489 698 A shows a device for the locking of rotor blades of turbines individually positively retained in axial slots. A T-form slot with undercuts is located on the end face of a shaft collar in such a way that the undercut intersects from the bottom the slot base of the retaining slots of the rotor blades. For the axial locking of the rotor blades a locking element is insertable in the T-form slot after the fitting of the rotor blades, which engages in a recess correspondingly formed in the blade root.

In addition, it is known that rotor blade roots of rotor blades of a compressor are locked against axial displacement by plastic deforming.

FIG. 7 shows for this a cut-out of a compressor disk 19 as claimed in the prior art. For the holding of rotor blades, retaining slots 21 are provided in the outer periphery 23 of the compressor disk 19. In addition, recesses 29 are located on the two end faces 25 of the compressor disk 23, which in each case merge into the slot base 27 of the radially outer-lying retaining slot 21.

FIG. 8 shows the cross section through a compressor disk 19 according to FIG. 7 along the section VIII-VIII. The recess 29 is constructed as a chamfer 30 with an angle of 45°.

After the introducing of a rotor blade 16, material of the rotor blade root 33 is plastically deformed into the region of the chamfer 30 on both sides by a caulking action. The projection formed in this way on the rotor blade root 33 then locks the rotor blade 16 against axial displacement, while the projection bears against the chamfer 30 which is inclined by 45° to the displacement direction.

As, however, during the caulking action the projection on its side facing the chamfer assumes a rounded form, the latter bears only partially on the chamfer which can lead to a smaller retaining force.

During the starting of the cold compressor and after the shutting down of the hot compressor, axially orientated stresses can arise in the rotor blade fastening owing to different thermal expansions of rotor blade and disk, which with repeated occurrence can deform the projection. This effect, also known as "Blade Walk", can lead to the axial play of the compressor rotor blades and this to flow losses in the compressor.

SUMMARY OF THE INVENTION

Hence, the object of the invention is to specify a rotor for a turbo-engine which without additional components enables a more secure fastening of rotor blades with simple geometric arrangement on the rotor.

The problem focused on the rotor is solved by the features of the claims. Advantageous developments are specified in the dependent claims.

The solution to the problem specifies that an annular groove extending in the axial direction coaxial to the rotational axis of the rotor is provided at least in one end face of the shaft collar, which intersects the slot base of each retaining slot and as deformation material of the blade root of the rotor blade is plastically displaced into the annular groove.

The invention is based on the knowledge that a holding area, which below the slot base of the retaining slot lies in the coaxial annular groove and serves for the holding of the material of the blade root, has a more advantageous shape for the projection formed by the caulking. The material of the rotor blade root plastically deformed after a caulking then bears better against the annular groove so that a loss-affected axial play of the rotor blade is avoided. Additional fastening components are inapplicable.

Hitherto in the prior art each chamfer was manufactured in a separate milling process. The annular groove, however, can be manufactured during the turning process by which the contour of the end face is manufactured. Therefore, in only one manufacturing process the holding area into which material of the blade root is displaceable is created below each retaining slot. This reduces the manufacturing costs and the manufacturing time of the rotor.

Within the scope of an advantageous development, the annular groove has an annular groove base and two flanks, wherein each flank of the annular groove merges into the annular groove base by a rounding. By this, notch stresses in the shaft collar, which would be created with a sharp transition from flank to the annular groove base, are avoided.

On the cut edge formed by the slot base of the retaining slot and the cut edge formed by the inner face of the annular groove these include a tangent angle which lies in a plane which is spanned by the radius of the rotor and the rotational axis of the rotor. As a result, the slot base of the retaining slot can intersect the radially further inner-lying rounding of the annular groove. The tangent angle on account of the rounding can then lie in an order of magnitude of between 50° and 90° so that the shape of the holding area comes geometrically very close to the shape of the projection. Therefore, by the caulking action a projection can be formed which has an angle of 50° to 90° to the slot base of the retaining slot. The most effective portion of the projection is that which is formed at an angle of 90° to the slot base of the retaining slot.

More expediently the shaft collar is formed by a disk, especially by a compressor disk. The annular groove can be manufactured during the turning of the compressor disk so that the individual milling of each chamfer is inapplicable.

In a preferred development the rotor blade is installed in the respective retaining slot by its blade root formed complementarily to the retaining slot, wherein material of the blade root protrudes into the annular groove. After the introducing of the rotor blade into the retaining slot, material of the blade root is deformed by the caulking into the annular groove and, therefore, creates a mechanical lock against axial displacement. The retaining slot can be dovetail-shaped or fir-tree-shaped in cross section.

So that the rotor blade is locked against axial displacement in both directions, each end face of a disk has an annular groove. Therefore, each side of the blade root facing the end face is deformed by a caulking action and the rotor blade on both sides is locked against axial displacement in both directions.

The problem focused on the turbo-engine is solved in that this is equipped with a rotor as claimed in the claims. By this, the advantages outlined for the rotor are valid analogically also for the turbo-engine, especially if this is a compressor.

BRIEF DESCRIPTION OF THE DRAWINGS

The invention is explained with reference to a drawing. The drawing shows.

DETAILED DESCRIPTION OF THE INVENTION

Gas turbines and their principles of operation are generally known. The gas turbine has in essence a compressor, a combustion chamber and a turbine unit along a rotor. The air drawn in and compressed by the compressor is mixed with a fuel and combusted in the combustion chamber into a hot gas which then expands in the turbine unit performing work on the rotor of the gas turbine. The rotor of the gas turbine then drives the compressor and a working machine, such as a generator.

In the compressor two blade rings in each case form a compressor stage, wherein viewed in the flow direction a ring of rotor blades rotatably fastened on the rotor follows in each case a stationary ring of stator blades. In the same way, two blade rings form in each case a turbine stage, wherein viewed in the flow direction a stationary stator blade ring follows in each case a ring of rotor blades rotatably fastened on the rotor.

The rotor of the gas turbine has for each rotor blade ring a disk or a shaft collar upon which are fastened the rotor blades of the respective ring.

Figure 1:
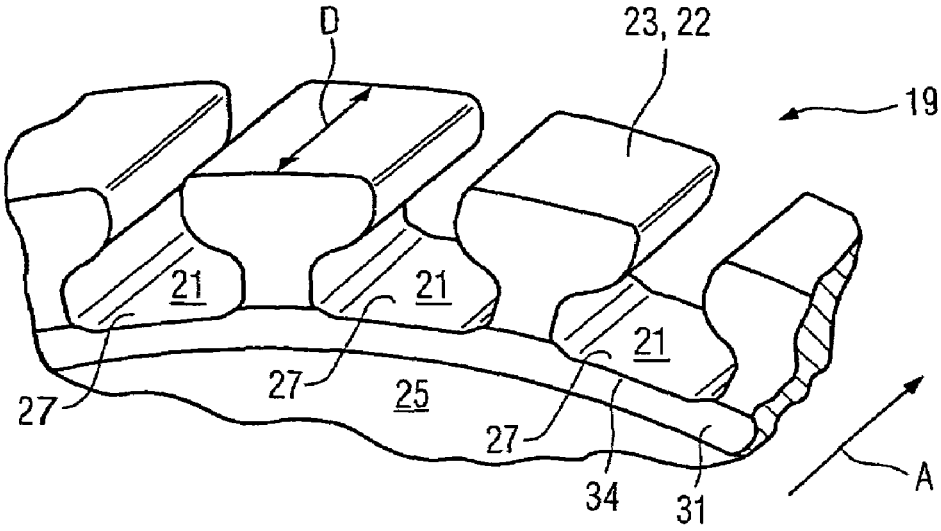
FIG. 1 a compressor disk according to the invention in a perspective view.

FIG. 1 shows a segment of such a disk as a compressor disk 19 according to the invention. The compressor disk forms a shaft collar 22 which on its outer periphery 23 has transversely extending retaining slots 21 for the holding of rotor blades 16. An annular groove 31 located coaxially to the rotational point of the rotor and extending in an axial direction A is provided in the region of the slot base 27 of the retaining slot 21. The annular groove 31 is manufacturable during the manufacture of the compressor disk 19 during the turning of the end face 25 and, therefore, within the former working step. The annular groove 31 intersects each retaining slot 21 in the region of the slot base 27. Therefore, a holding area 34 is made available into which material of the blade root 33 is plastically displaceable by caulking, for example.

Figure 2:
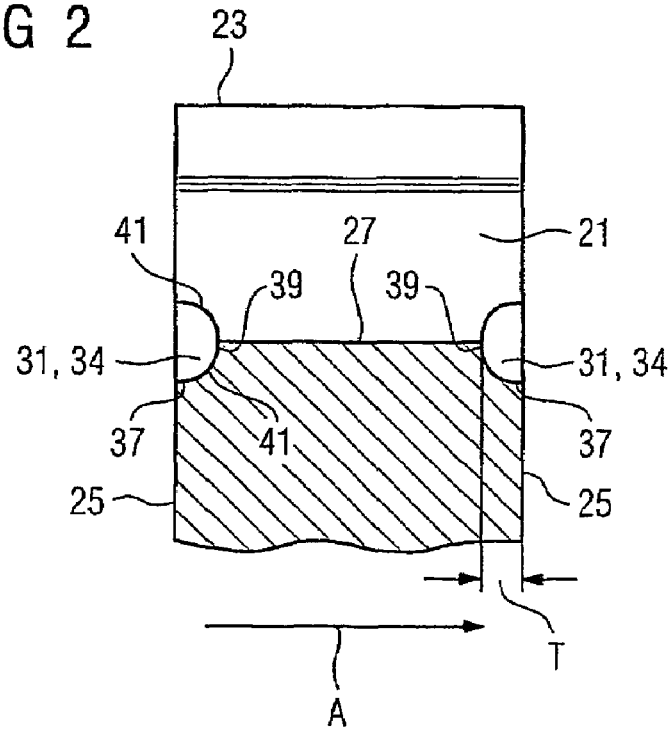
FIG. 2 a section through a compressor disk according to FIG. 1.

FIG. 2 shows a cut-out through the cross section of a compressor disk 19 according to FIG. 1. The shaft collar 22 formed by the compressor disk 19 has on each end face 25 the annular groove 31 which is formed U-shaped in cross section. With a depth T, each annular groove 31 extends in the axial direction so that the axial length of the slot base 27 of the retaining slot 21 is shortened in relation to a disk thickness D (see FIG. 1).

The annular groove 31 has in cross section a flank 37 in each case as a side wall which by a rounding 41, which can be constructed as a radius, ellipse, concave form or comparable, merges into the annular groove base 39.

The annular groove 31 is provided on both end faces 25 of the compressor disk 19 so that each rotor blade 16 can be axially locked by two caulking actions.

Figure 3:
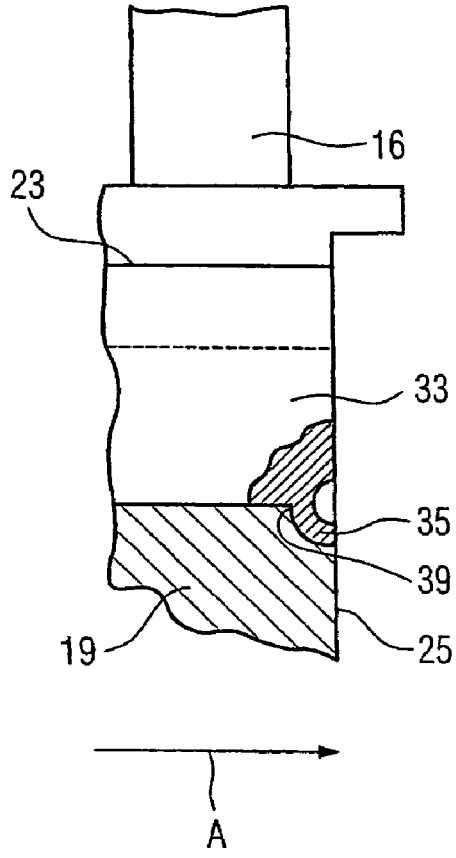
FIG. 3 a section through a compressor disk according to FIG. 1 with a plastically deformed blade root of a rotor blade, FIG. 4 a partial side view of the compressor disk according to FIG. 3, FIGS. 5, 6 detail through the section of a compressor disk with an annular groove, FIG. 7 a perspectively represented compressor disk with retaining slots as claimed in the prior art and FIG. 8 a section through the compressor disk according to FIG. 7.

FIG. 3 shows the section through a compressor disk 19 with a rotor blade 16, the blade root 33 of which is already plastically deformed. The material of the blade root 33 protrudes radially inwards into the annular groove 31 as a projection 35. The annular groove base 39 serves as an abutment for the projection 35, which, therefore, locks the rotor blade 16 against axial displacement.

Figure 4:
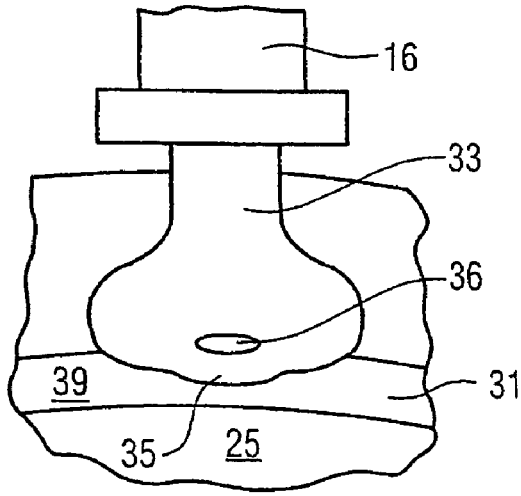

In FIG. 4, a cut-out of the side view of the compressor disk 19 according to FIG. 3 is shown. The rotor blade root 33 of the rotor blade 16 is deformed by the caulking action. A caulking 36 is therein located in the lower region of the blade root 33 and covers about a third of the width of the blade root 33.

Figure 5:
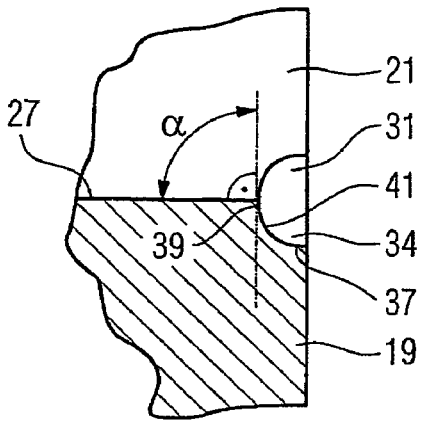
Figure 6:
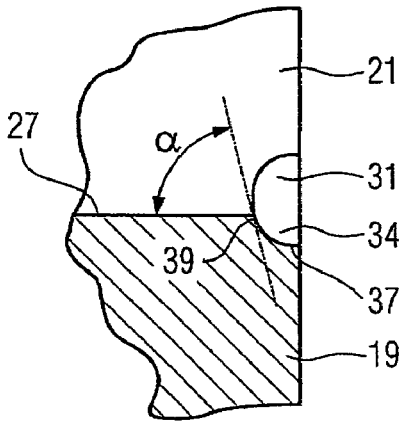

FIGS. 5 and 6 show the section through the compressor disk 19 with the coaxial annular groove 31 in detail.

A tangent, which with the slot base 27 of the retaining slot 21 includes a tangent angle $\alpha$, lies on the curvature of the annular groove 31 in the region of the transition of annular groove 31 to the slot base 27.

This lies in an imaginary plane, which is spanned by the rotational axis of the rotor and by the radial direction of the rotor, which extends through a retaining slot 21. Depending upon the distance of the slot base 27 to the rotational axis of the rotor the tangent angle $\alpha$ has a value of 50° to 90°. If the annular groove base 39 intersects the slot base 27 of the retaining slot 21, then a tangent angle $\alpha$ of 90° is provided. If, however, the annular groove 21 is located radially further out so that the radially inner rounding 41 intersects the slot base 27 of the retaining slot 21, then the tangent angle $\alpha$ reduces corresponding to the selected rounding 41.

The greater the tangent angle $\alpha$ is the better can the projection 35 lock the rotor blade 16 against axial displacement as the latter is supported on the annular groove base 39.

Figure 7:
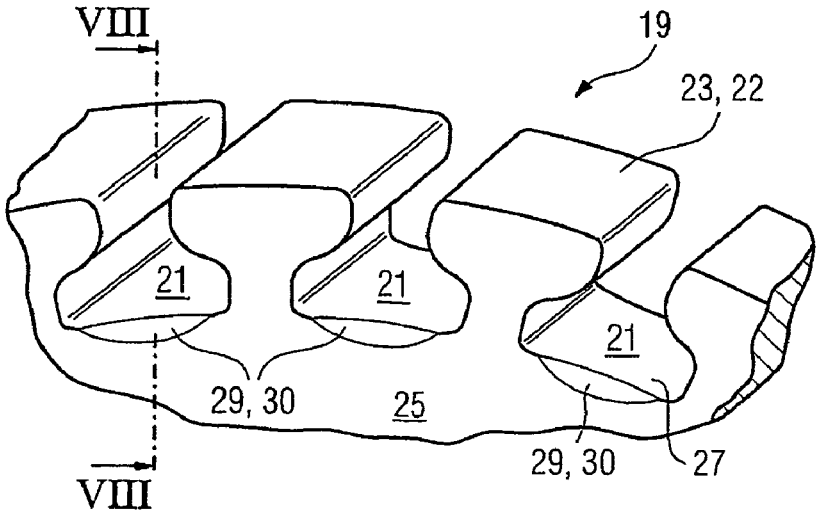
FIG 7 (Prior art)
Figure 8:
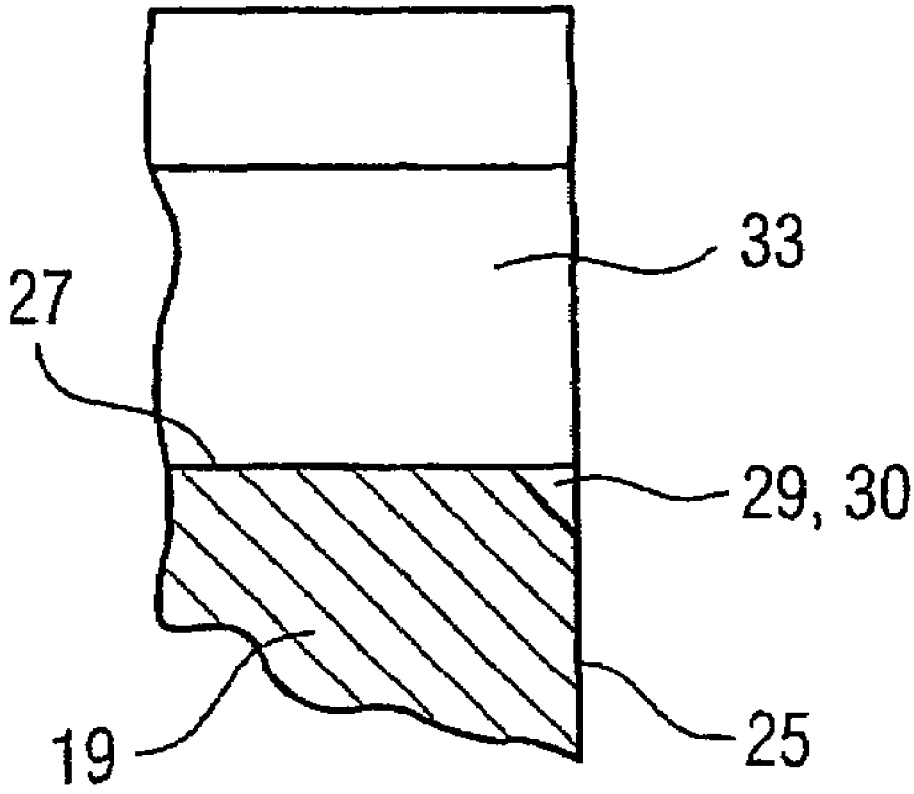
FIG 8 (Prior art)

Compared with the prior art according to FIG. 7, in which a tangent angle of 45° formed by the chamfer 30 exists, a more effective axial locking of the rotor blade 16 can be achieved by the embodiment according to the invention.

The invention claimed is:

1. A rotor for a turbo-engine having an axis, comprising:

a rotor shaft arranged along the rotor axis;

a rotor blade including a root, said root having a projection configured to extend in an axial direction;

a shaft collar arranged coaxially on the rotor shaft comprising:

an outer periphery, a first radially extending end face arranged perpendicular to the rotor axis, a second radially extending end face arranged opposite the first end face and perpendicular to the rotor axis, a plurality of retaining slots arranged in the outer periphery extending transversely to the circumferential direction each retaining slot having a slot base with a length extending in the axial direction, and an annular groove arranged coaxially to the rotational axis of the rotor on the first end face extending in the axial direction with a depth and intersecting the slot base of each retaining slot at an annular groove base such that the length of the slot base in the axial direction is reduced by the depth of the annular groove in the axial direction; said annular groove is configured to form a holding area of the rotor blade root based on the projection of the rotor blade root being configured to be displaced into the annular groove and abut with the annular groove base.

2. The rotor as claimed in claim 1, wherein the annular groove has the annular groove base and two flanks wherein each flank of the annular groove merges into the annular groove base by a rounding.

3. The rotor as claimed in claim 2, wherein a tangent angle that extends in a plane spanned by the radius of the rotor and the rotor axis is formed between the rotor axis and an intersection of the rounding with the annular groove base ranges between 50° and 90°.

4. The rotor as claimed in claim 2, wherein a tangent angle that extends in a plane spanned by the radius of the rotor and the rotor axis is formed between the rotor axis and an intersection of the rounding with the annular groove, wherein the tangent angle is 90°.

5. The rotor as claimed in claim 1, wherein the annular groove is sized and configured to inhibit rotor blade motion relative to the rotor in the axial direction by the abutment of the projection with the annular groove base.

6. The rotor as claimed in claim 1, wherein each retaining slot is dovetail-shaped or fir-tree-shaped in cross section.

7. The rotor as claimed in claim 1, wherein each end face of the shaft collar has an annular groove.

8. A turbo-engine and a rotational axis, comprising:

a rotor blade including a root, said root having a projection configured to extend in an axial direction;

a rotor arranged coaxially having the rotational axis formed from a plurality of rotor disks, each disk having a collar section arranged coaxially on the disk and comprising:

an outer periphery, a first radially extending end face arranged perpendicular to the rotational axis, a second radially extending end face arranged opposite the first end face and perpendicular to the rotational axis, a plurality of retaining slots arranged in the outer periphery extending transversely to the circumferential direction each retaining slot having a slot base with a length extending in the axial direction parallel to the rotational axis and two opposite side flanks, and an annular groove arranged coaxially to the rotational axis of the rotor on the first end face extending in the axial direction with a depth and intersecting the slot base of each retaining slot at an annular groove base such that the length of the slot base in the axial direction is reduced by the depth of the annular groove in the axial direction; said annular groove is configured to form a holding area of the rotor blade root based on the projection of the rotor blade root being configured to be displaced into the annular groove and abut with the annular groove base;

an inlet section arranged coaxially with the rotational axis that admits an inlet fluid;

a compressor section arranged coaxially with the rotational axis that receives the inlet fluid and compresses the fluid to produce a compressed fluid;

a combustion section that receives the compressed fluid and mixes the compressed fluid with a fuel to create a compressed fluid and fuel mixture and combusts the mixture to produce a hot fluid; and a turbine section arranged coaxially with the rotational axis that receives the hot fluid and expands the hot fluid.

9. The turbo-engine as claimed in claim 8, wherein the annular groove is sized and configured to inhibit rotor blade motion relative to the rotor in the axial direction by the abutment of the projection with the annular groove base.

10. The turbo-engine as claimed in claim 8, wherein each retaining slot is dovetail-shaped or fir-tree-shaped in cross section.

11. The turbo-engine as claimed in claim 8, wherein the annular groove has the annular groove base and two flanks wherein each flank of the annular groove merges into the annular groove base by a rounding.

12. The turbo-engine as claimed in claim 11, wherein each end face of the disk has an annular groove.

13. The turbo-engine as claimed in claim 11, wherein a tangent angle that lies in a plane spanned by the radius of the rotor and the rotor axis is formed between the rotor axis and an intersection of the rounding with the annular groove base ranges between 50° and 90°.

14. The turbo-engine as claimed in claim 11, wherein a tangent angle that lies in a plane spanned by the radius of the rotor and the rotor axis is formed between the rotor axis and an intersection of the rounding with the annular groove base, wherein the tangent angle is 90°.

* * * * *